US009200514B2

(12) United States Patent
Cawood et al.

(10) Patent No.: US 9,200,514 B2
(45) **Date of Patent: *Dec. 1, 2015**

(54) TUBULAR ROCK ANCHOR

(71) Applicant: GIDDICCA (PTY) LTD, Johannesburg (ZA)

(72) Inventors: Martin Cawood, Johannesburg (ZA); At Jacobs, Johannesburg (ZA); Paolo Ettore Pastorino, Johannesburg (ZA); Diedrick Kapp, Johannesburg (ZA); Nicholas Marvin, Johannesburg (ZA); David Charles Tyrer, Johannesburg (ZA); James William Sheppard, Johannesburg (ZA); Brendan Robert Crompton, Johannesburg (ZA)

(73) Assignee: GIDDICCA (PTY) LTD, Johannesburg (ZA)

( * ) Notice: Subject to any disclaimer, the term of this patent is extended or adjusted under 35 U.S.C. 154(b) by 0 days.

This patent is subject to a terminal disclaimer.

(21) Appl. No.: 14/613,677

(22) Filed: Feb. 4, 2015

(65) Prior Publication Data

US 2015/0192015 A1 Jul. 9, 2015

Related U.S. Application Data

(63) Continuation-in-part of application No. 13/490,689, filed on Jun. 7, 2012, now Pat. No. 8,985,910.

(30) Foreign Application Priority Data

| | | |
|---|---|---|
| Jun. 8, 2011 | (ZA) | 2011/04244 |
| Aug. 19, 2011 | (ZA) | 2011/06094 |
| Oct. 21, 2011 | (ZA) | 2011/07785 |

(51) Int. Cl.
*E21D 20/02* (2006.01)

(52) U.S. Cl.
CPC ..... *E21D 20/026* (2013.01); *E21D 20/025* (2013.01)

(58) Field of Classification Search
CPC ... E21D 20/025; E21D 20/026; F16B 13/143; F16B 13/144; B05C 17/00596
USPC ..... 405/258.1, 259.1, 259.5, 259.6, 263, 405/266, 269; 222/135, 136, 137, 145.1, 222/145.4, 145.5, 145.6
See application file for complete search history.

(56) References Cited

U.S. PATENT DOCUMENTS

| | | | |
|---|---|---|---|
| 4,067,479 | A | 1/1978 | Moline |
| 4,601,614 | A | 7/1986 | Lane et al. |

(Continued)

FOREIGN PATENT DOCUMENTS

| | | |
|---|---|---|
| DE | 10321175 | 8/2004 |
| RU | 2114309 | 6/1998 |

(Continued)

OTHER PUBLICATIONS

RU201270609 International Search Report dated Dec. 7, 2012 (3 pages).

*Primary Examiner* — John Kreck
*Assistant Examiner* — Stacy Warren
(74) *Attorney, Agent, or Firm* — Michael Best & Friedrich LLP

(57) ABSTRACT

A rock anchor includes a cartridge positioned in an elongate tubular body and having a rigid tubular housing. First and second compartments are defined within the cartridge. First and second adhesive components are positioned within the respective first and second compartments and are fluidly separated by a partitioning wall. A mixer is positioned within the elongate tubular body at a leading end of the cartridge. A pressing member is positioned within the cartridge towards a trailing end and includes a bladed formation which is operable to sever the partitioning wall when the bladed formation is caused to advance towards the leading end in response to fluid flowing into the cartridge, to thereby force the first adhesive component from the first compartment and the second adhesive component from the second compartment towards the leading end and into the mixer.

6 Claims, 11 Drawing Sheets

(56) References Cited

U.S. PATENT DOCUMENTS

| | | | |
|---|---|---|---|
| 4,622,085 | A | 11/1986 | Yamada et al. |
| 5,423,752 | A | 6/1995 | Haber et al. |
| 5,882,148 | A | 3/1999 | Mraz |
| 6,634,524 | B1 | 10/2003 | Helmenstein |
| 2001/0028833 | A1 | 10/2001 | Sager et al. |
| 2006/0153645 | A1 | 7/2006 | Rataj et al. |
| 2009/0142142 | A1 | 6/2009 | Bayerl et al. |
| 2009/0304455 | A1 | 12/2009 | Bayerl et al. |
| 2010/0284762 | A1 | 11/2010 | Wieczorek et al. |

FOREIGN PATENT DOCUMENTS

| | | |
|---|---|---|
| SU | 625048 | 8/1978 |
| SU | 1580024 | 7/1990 |
| WO | 96/07015 | 3/1996 |
| WO | 03/044324 | 5/2003 |
| WO | 2010/133883 | 11/2010 |
| WO | 2011/063433 | 5/2011 |

TUBULAR ROCK ANCHOR

CROSS-REFERENCE TO RELATED APPLICATIONS

This application is a continuation-in-part of co-pending patent application Ser. No. 13/490,689 filed Jun. 7, 2012, which claims foreign priority to South African Patent Application No. 2011/04244 filed Jun. 8, 2011, South African Patent Application No. 2011/06094 filed Aug. 19, 2011, and South African Patent Application No. 2011/07785 filed Oct. 21, 2011, the disclosures of which are incorporated by referenced herein in their entireties. Priority to these applications is hereby claimed.

BACKGROUND OF THE INVENTION

This invention relates to a rock anchor for use in full column adhesive bonding applications.

A problem with using a resin or grout to secure a rock anchor within a rock hole is that the resin, typically comprising of an adhesive resinous component and a catalytic component, needs to be adequately mixed for the resultant resin mixture to set with sufficient binding strength.

Hereinafter, the terms rock anchor and rock bolt are used interchangeably to describe a device which has an elongate body, and which is inserted into a hole drilled into a rock face, to stabilize the rock to prevent collapse or rock fall.

Moreover, the resin is an expensive consumable that is often wasted; introduced into the rock hole in cartridges in amounts surplus to requirement for the particular hole-size, resulting in resin leaking from the hole.

Resin cartridges are also often damaged during storage or transportation to site because of the delicate frangible nature of the cartridge membrane.

Also, there is no way of ensuring a full column bond i.e. the annular space between the anchor and the rock hole wall is completely filled with resin, with a number of resin cartridges, introduced into the rock hole ahead of the anchor. This is because some of the cartridges may only partially rupture, or not rupture at all, when the rock anchor is moved through the hole. Therefore insufficient resin is mixed or introduced into the annular space to fix the anchor in place. Allied to this problem is that the cartridge material may form an adhesive barrier to the anchor and resin, or resin and rock wall, interface, a problem known as finger gloving.

Another problem comes when resin cartridges are inserted ahead of a rock anchor trapping air in the blind end of the rock hole. When the cartridges rupture and the resin sets, air voids get trapped within the set resin at this end. It is critical that a leading portion of the rock anchor is properly bonded to the rock hole as the mass of the rock supported by the anchor is often effectively suspended from this portion of the rock anchor, bonded to the rock hole.

When a resin capsule is placed in a hollow rock bolt, in a configuration as described in ZA2003/04376, another problem is experienced. The thin plastics material making up the frangible capsule does not release its contents in a controlled manner. The capsule may buckle at any point there-along, causing a bottleneck or blockage in the cartridge lumen, preventing the resin contained behind this point from progressing to a capsule outlet. Furthermore, the material tends to bunch when compressed, by a pressing means, and is often forced into a mixing device at a leading end of the bolt thus clogging up the device. As a result, the mixing ratios of the two part resin components in the capsule cannot be controlled which can lead to the resin improperly setting.

SUMMARY OF THE INVENTION

It is an object of this invention to at least partially overcome the abovementioned problems.

Hereinafter, "adhesive" refers to a system which includes at least one low viscosity liquid adhesive component which is free-flowing before activation and which after activation, sets or hardens. An "adhesive component" bears a corresponding meaning.

"Fluid pressure" as hereinafter used includes pressure that is caused hydrostatically or hydraulically.

In a first aspect, the invention provides a cartridge for containing a multi-component adhesive system for use in a rock anchor installation which includes a rigid tubular housing, which has a forward end and an opposed trailing end, within which at least one compartment is defined in which is contained an adhesive component wherein the at least one compartment yields to volumetrically reduce, under fluid pressure created by a fluid input into the housing, thereby to extrude the adhesive component.

Preferably, the fluid is input from the trailing end and the adhesive component is extruded from the forward end.

The housing may be complementarily dimensioned to fit within the tubular body of a tubular rock anchor.

Preferably, the rigid tubular housing is made from a rigid plastics material.

The cartridge may contain a pressing member located within the housing, between the at least one compartment and the trailing end, which moves under pressure created by a fluid input into the housing, to cause the at least one compartment to extrude its adhesive component.

The pressing member may be slidingly, preferably sealingly, engaged with inner walls of the housing.

Preferably, within the housing, a first compartment and a second compartment are defined, in which are respectively contained a first adhesive component and a second adhesive component.

Each compartment may be a discrete compartment, spaced from each other and sidewalls of the cartridge housing. Alternatively, at least one wall of each compartment may be integrally formed with, or attached to, sidewalls of the cartridge body.

The housing may include at least one axially extending internal partitioning wall which divides the housing's interior into the first compartment and the second compartment. Alternatively, the cartridge may include an elongate tube which fits within the housing in co-axial extension and which defines the first compartment and whereby the second compartment is defined by a space between the housing and the tube.

The tube may have walls which are adapted to axially compress in a controlled manner about predefined annular zones, when a force is applied at one end, to extrude its adhesive content.

Preferably, the tube is made of a suitable flexible plastics material.

The tube may be a tubular bellows-type tube, the walls of which comprise a plurality of corrugated annular sections, each one of these sections defining an annular zone about which the tube is adapted to axially compress.

The cartridge may be closed at the forward end, through which a sealed outlet from each of the compartments is defined.

An indicator material, which changes colour to provide a visual indication of the extent to which the adhesive components have set when mixed, may be included with a component of the adhesive system.

The invention also extends to an adhesive containing container for use with a tubular rock anchor which has a tubular bellows-type body, the walls of which comprise a plurality of corrugated annular sections, each one of these sections defining an annular zone about which the container is adapted to axially compress.

The body may have an outlet end and an opposed end, which is closed.

Preferably, the container is made of a suitable flexible plastics material.

The invention further provides a rock anchor which includes an elongate tubular body which extends between a first end and an opposing second end, a cartridge for containing a multi-component adhesive system, in the tubular body, wherein the cartridge has a rigid tubular housing within which at least one compartment is defined, in which is contained an adhesive component of the system, wherein the at least one compartment yields to volumetrically reduce under fluid pressure created by a fluid input into the housing, thereby to extrude the adhesive components.

Preferably, the anchor includes a fluid inlet valve assembly which introduces the fluid from the first end and wherein the at least one adhesive component is extruded towards the second end.

The inlet valve assembly may be sealingly engaged with a trailing end of the cartridge housing to avoid flow of the fluid into the space between the anchor body and the cartridge housing.

Preferably, the cartridge contains a pressing member located within the housing, between the at least one compartment and the trailing end, which moves under pressure created by the fluid input, towards the second end of the anchor body, thereby to volumetrically reduce the at least one compartment.

The pressing member may be slidingly, preferably sealingly, engaged with inner walls of the housing.

The cartridge may include an elongate tube which fits within the housing in co-axial extension and which defines the at least one compartment.

Preferably within the cartridge, a first compartment and a second compartment are defined, in which are respectively contained a first adhesive and a second adhesive component.

The second compartment maybe defined by a space between the housing and the tube.

The tube may have walls which are adapted to axially compress in a controlled manner about predefined annular zones, when a force is applied at one end, to extrude its adhesive content.

Preferably, the tube is made of a suitable flexible plastics material.

The tube may be a tubular bellows-type tube, the walls of which comprise a plurality of corrugated annular sections, each one of these sections defining an annular zone about which the tube is adapted to axially compress.

The cartridge may be closed at the forward end, through which a sealed outlet from each of the compartments is defined.

The rock anchor may include a mixing means into which each adhesive component of the adhesive passes to be reactively mixed.

The mixing means may be connected to the second end or at least partially located within the body adjacent the second end.

The mixing means may be a static mixer.

The invention further provides a rock anchor which includes an elongate tubular body which extends between a first end and an opposing second end, an adhesive containing container as described above, a pressing member located within the tubular body between the container and the first end, and a fluid inlet valve assembly, or near the first end, wherein a fluid introduced into the tubular body causes the member to advance under pressure, through the valve assembly, towards the second end thereby to compress the container and to cause the adhesive content of the container to extrude therefrom.

The pressing member may slidingly, preferably sealingly, engage the inner walls of the tubular body.

The adhesive containing container may include a tubular bellows-type body, the walls of which comprise a plurality of corrugated annular sections, each one of these sections defining the annular zone about which the container is adapted to axially compress.

In use, the tubular body's second end lies adjacent a blind end of a rock hole.

Preferably, the tubular body is cylindrical and made from a metallic material.

In use, the extruded adhesive contents of the cartridge may then flow into an annular space defined between an outer wall of the anchor body and the wall of a rock hole, into which the anchor is placed, to set and secure the anchor in place in the hole.

Preferably, the tubular body has a predetermined volume to contain a cartridge with an amount of adhesive which is sufficient to substantially fill the annular space along a full length of the rock hole.

The rock anchor may include a mixing means, into which each adhesive component of the adhesive passes to be reactively mixed.

The mixing means may be connected to the second end or at least partially located within the body adjacent the second end.

The mixing means may be a static mixer.

In another aspect of the invention there is provided a modular rock anchor which includes a mixing means, an adhesive containing cartridge and an inlet valve assembly, each respectively serially connected and in fluid communication with the other to provide a modular assembly, and a rigid tubular sheath which at least partially encloses the modular assembly.

The mixing means may be a static mixer.

The cartridge may be any cartridge as described above.

The tubular sheath may be a metallic tube or cylinder.

In a final aspect of the invention there is provided a rock anchor which extends between a first end and an opposing second end, an adhesive containing container, containing an adhesive component, within the tubular body, which yields to volumetrically reduce under fluid pressure created by a fluid input into the housing, thereby to extrude the adhesive component.

BRIEF DESCRIPTION OF THE DRAWINGS

The invention is further described by way of examples with reference to the accompanying drawings in which.

DETAILED DESCRIPTION

Figure 1:
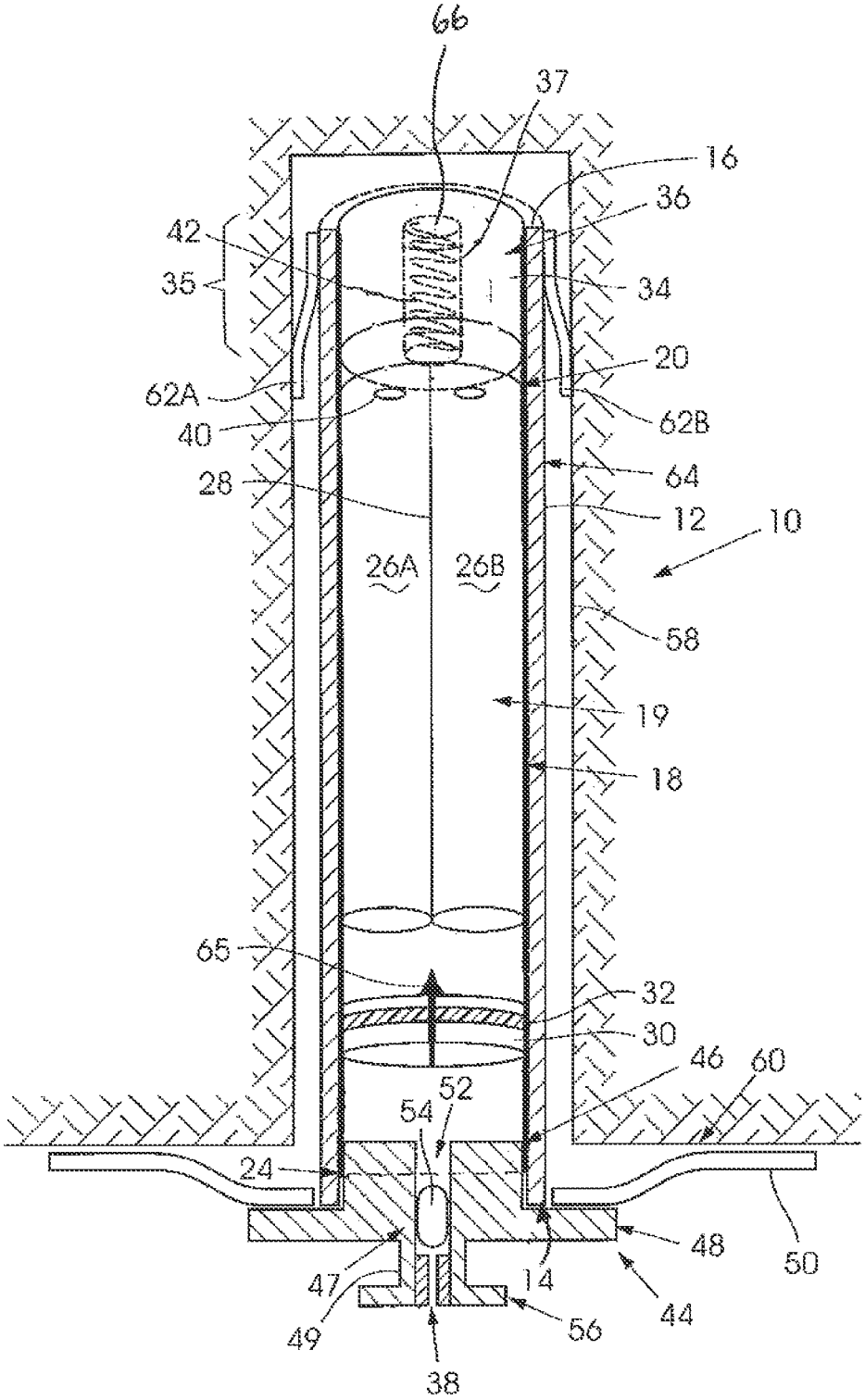
FIG. 1 diagrammatically illustrates a rock anchor in accordance with a first aspect of the invention.

In a first aspect of the invention, as illustrated in FIG. 1 of the accompanying drawings, there is provided a rock anchor 10, which includes an elongate tubular body 12 which is made from a suitable material, for example a mild steel and which extends between a first end 14 and a partially closed second end 16.

The tubular body contains a cartridge 18 which includes a cylindrical housing 19 made of a rigid plastics material, which is of complementary dimension to fit within the body. The cartridge housing has a leading end 20 and an opposed trailing end 24.

The cartridge 18 includes a first compartment and a second compartment, respectively designated 26A and 26B, divided by a partitioning wall 28, each of which contains a discrete fluid component of a two part adhesive system which, when mixed, react to set or gel. Each adhesive component, in this particular embodiment, is a free-flowing liquid, before mixing.

Figure 3:
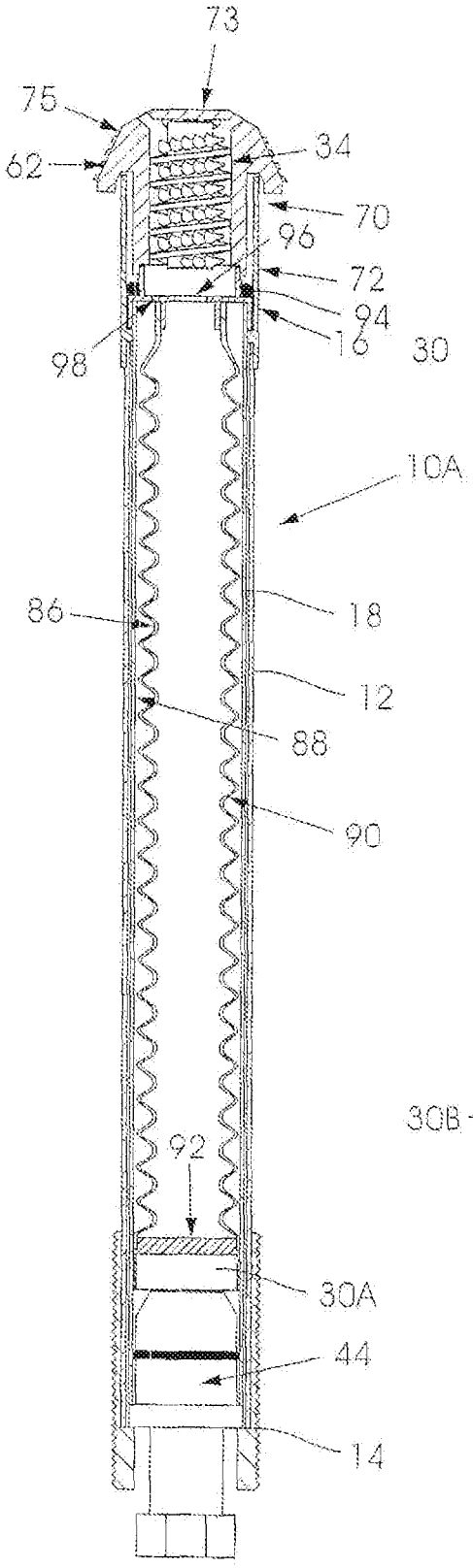
FIG. 3 illustrates, in longitudinal section a rock anchor in accordance with a second aspect of the invention.
Figure 3A:
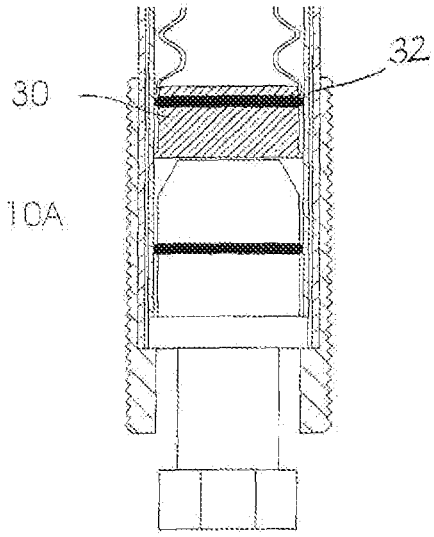
FIGS. 3A and 3B illustrate variations on a pressing member located within the rock anchor.
Figure 3B:
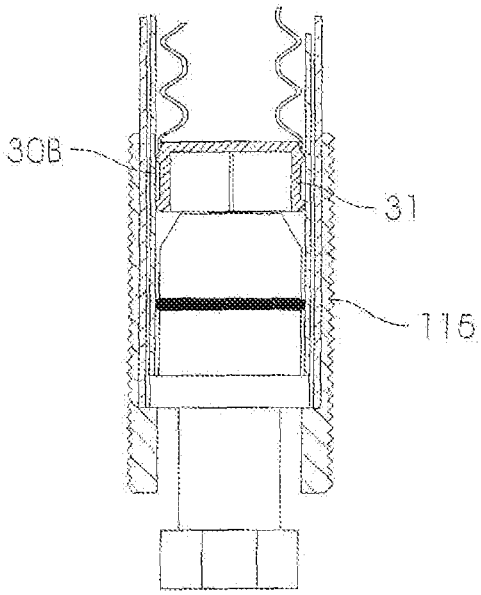

It is however anticipated, within the scope of the invention that only one component, housed in a single compartment within the cartridge housing, is free-flowing. The second component can be an activator or enzyme which can be solid or semi-solid, suitably located in another part of the anchor Within the cartridge housing 19, a disc-shaped pressing member 30 is located, between the adhesive component containing compartments and the trailing end 24 of the housing. The pressing member presented includes an annularly sealing ring 32 which provides a seal between the member and the inner wall surface of the housing. However, as illustrated in FIG. 3A and 3B, the pressing member 30 can be one of many embodiments. The pressing member 30A and 30B, as illustrated in FIGS. 3 and 3B, has a trailing perimeter skirt 31 which flares outwardly into sealing engagement with walls of the housing 19 under a force applied by a fluid input into the housing.

Figure 2A:
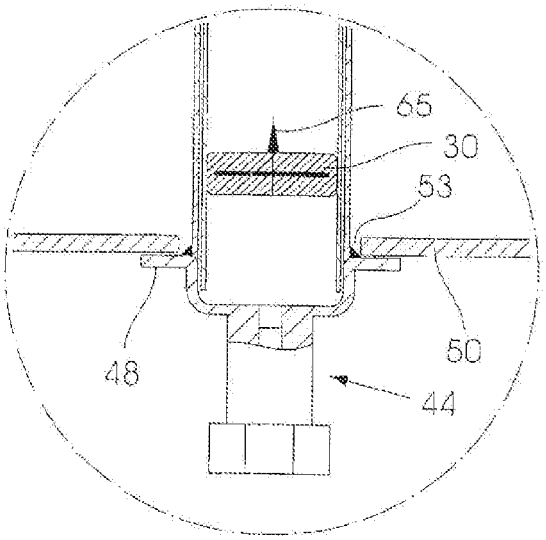
FIG. 2A illustrates a variation on how the valve assembly is connected to the rock anchor.
Figure 2:
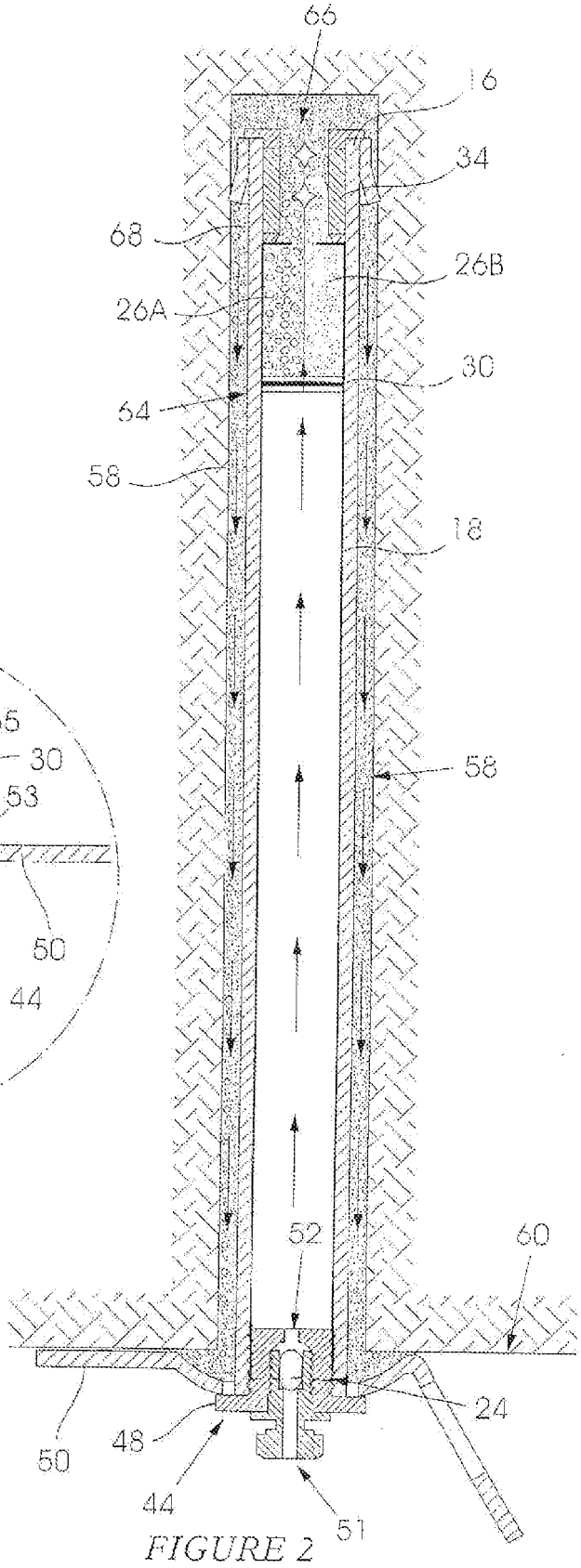
FIG. 2 illustrates, in longitudinal section, the rock anchor of FIG. 1, with a pressing member well advanced within the anchor.

A static mixer 34 is provided. In this embodiment, the static mixer is located within a first end section 35 of the body 12, as illustrated in FIGS. 1 and 2, press fitted or threadedly engaged with the inner walls of this section. However, it is anticipated within the scope of the invention that the mixing means can be attached to the second end 16 of the body or partially located within the first end section of the body.

The static mixer 34 can be of any suitable internal construction and configuration. In this particular embodiment, the mixer has a cylindrical body 36 with a passage 37, leading from outlets 40 in the leading end 20 of the cartridge, to an aperture 66 in the second end 16. A spiral formation 42 is positioned in each passage to spirally or helically move and mix the adhesive components as they are extruded from the cartridge 18, as is explained below.

Through the first end 14, of the tubular body 12, a fluid inlet valve assembly 44 is engaged with the anchor 10. The assembly has an outlet end 46 which is press fitted into and sealing engaged with, a trailing end portion of the cartridge housing 19. Alternatively the assembly can be welded to the body's first end as illustrated in FIG. 2A along weld lines 53. However it is preferable that the valve assembly delivers a fluid input to within the cartridge housing 19 and not the anchor body 12 so that all of the working fluid is delivered against the pressing member 30 and not dissipated between the anchor body 12 and the cartridge housing.

The assembly 44 includes a fluid inlet valve 47 and a flange 48 against which, in use, a face plate 50 rests, as illustrated in FIG. 1. The fluid valve 47 comprises a bore 38 which extends from an inlet 51, in a projecting portion 49 of the assembly 44, to above outlet 52 opening into the housing's interior. A valve element 54 is located within the bore to reciprocate therein. A hose coupling formation 56 is presented, on the outer-surface of an end of the portion 49, which is configured to be connected to a connector end of a pressurised fluid hose (not shown), which runs from a pressurised fluid (water) source.

The valve assembly 44 can include an indicator mechanism (not shown) which is co-axially located in the fluid bore 38 to move axially outwardly when a predetermined pressure within the anchor 10 has been reached to provide a visual indication of this to an installer of the rock anchor. The predetermined pressure is a pressure sufficient to drive the pressing member 30 to a position, within the housing 19, at which substantially the entire adhesive contents of the compartments 26 are extruded. The indicator mechanism can be a mechanism as described in PCT/ZA2010/000074, the specification of which is included herein by reference.

In use of the rock anchor 10, and with reference to FIGS. 1 and 2, a rock hole 58 is drilled into a rock face 60 by any suitable means. Thereafter, the rock anchor 10 is passed through a hole in the face plate 50 before being inserted in the rock hole, with a second end 16 leading until the flange 48 abuts the plate 50 which is held against the rock face. A plurality of spring biased locating members, (respectively designated 62A and 62B), extend from an outer surface 64 of the first end section 35 of the tubular body 12 to keep the anchor temporarily in position within the rock hole once inserted.

The connector end of the fluid hose is then connected to the hose coupling formation 56 of the valve assembly 44, and a stream of working fluid, such as water, under pressure, is introduced into the cartridge housing 19 through the bore 38, behind the pressing member 30. As the fluid pressure increases, the pressing member is actuated under force of the fluid to advance within the housing, towards the second end 16, breaking, tearing or severing the partitioning wall 28 in the process and forcing the adhesive components of each compartment 26 towards the respective outlet 40 and on into the static mixer 34. This process is illustrated in FIG. 2.

To enable the pressing member 30 to sever the partitioning wall 28 the member can include a means, for example a bladed formation 65, which cuts the partitioning wall as the pressing member advances.

As the pressing member 30 is sealing engaged with the inner surface of the housing 19, the adhesive components are prevented from flowing back and out of the trailing end 24 of the housing and the first end 14 of the anchor.

As the adhesive components move through the static mixer 34, they come into mixing contact with each other as each component flows over the blades of the spiral formation 42. Still liquid, the resultant reactive adhesive mixture flows from the mixer through the aperture and into an annular space 68 defined between the outer surface 64 of the rock anchor 10 and the rock-hole 58 wall. The mixture, which has been sufficiently mixed in the mixer, begins to set in this annular space, fixing the anchor 10 within the rock hole. With the anchor 10 fixed within the rock hole 58 and the flared skirt 48 abutting against the face plate 50, the plate is yield in supportive contact with the rock face 60.

Specific commercial embodiments of this general embodiment of the first aspect of the invention, are described towards the end of this section.

In describing a second aspect of the invention, differentiated from the first aspect in the absence of a bladed formation on the pressing member, like features, with respect to the first aspect of the invention, bear like reference numerals.

Figure 4:
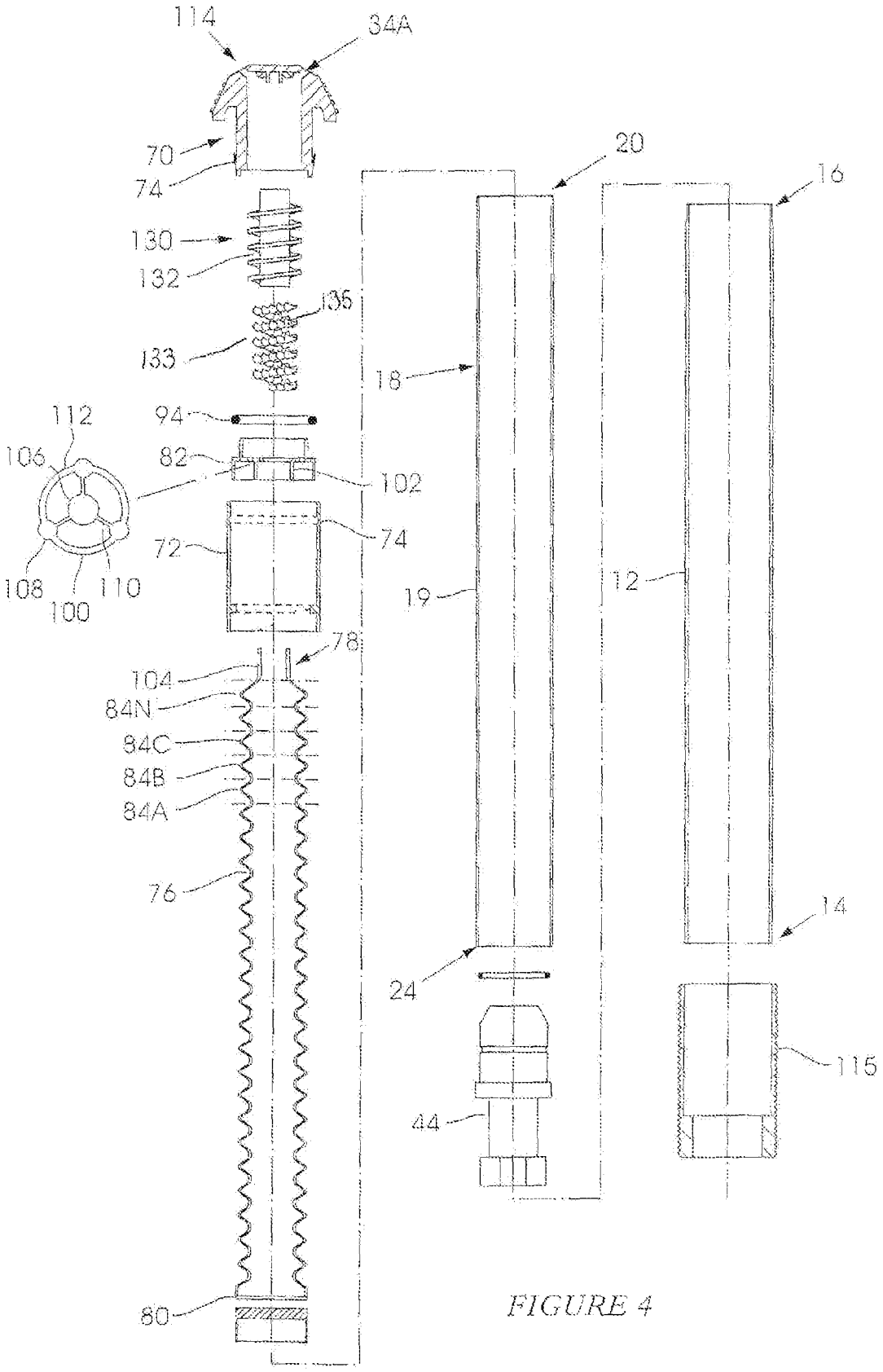
FIG. 4 is an exploded view of FIG. 3 illustrating each of the components making up the rock anchor.
Figure 5A:
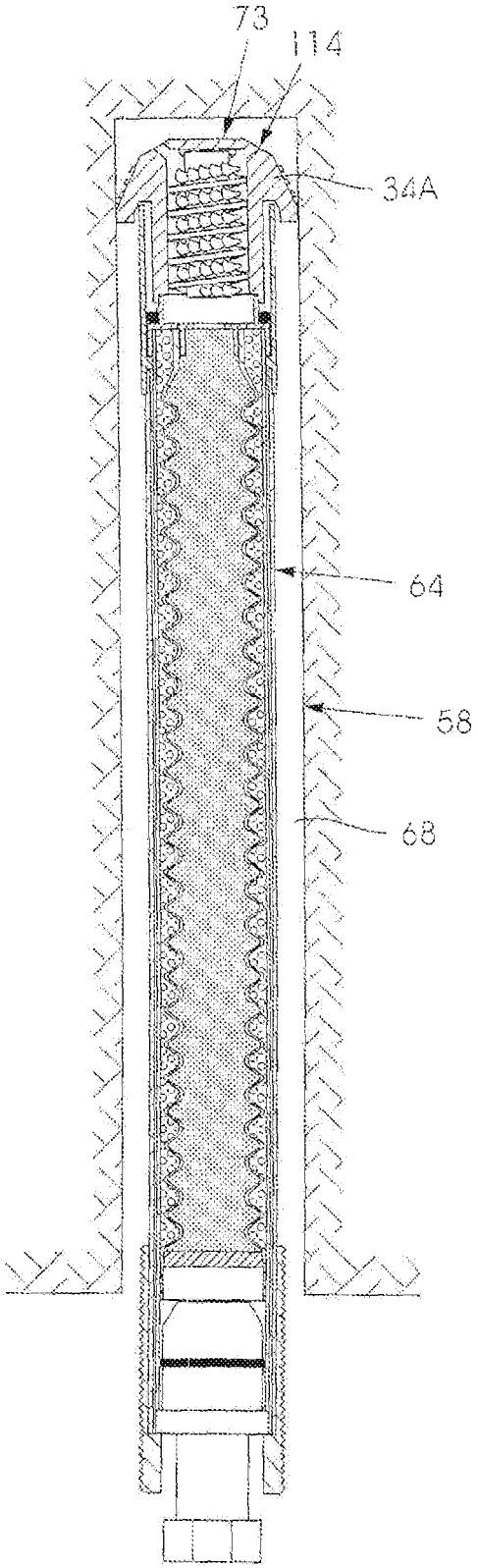
FIGS. 5A and 5B respectively illustrate, in longitudinal section the pressing member in a first position and in an advanced position wherein adhesive contents of the anchor are extruded.
Figure 5B:
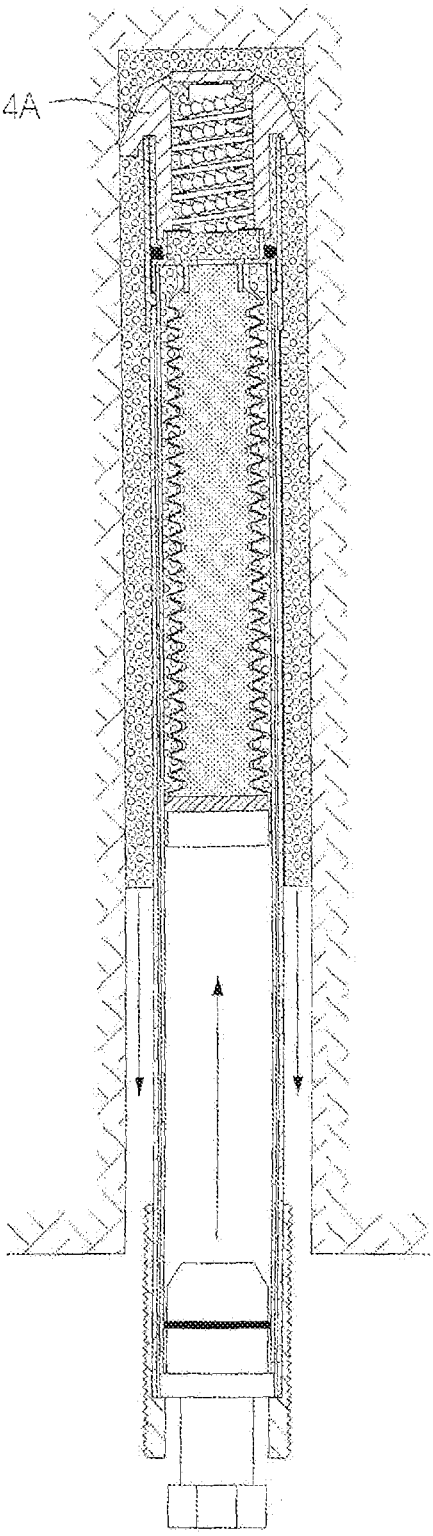

In the second aspect of the invention, as illustrated in FIGS. 3 to 5 of the accompanying drawings, a modular rock bolt 10A is provided which includes an elongate tubular body 12 into which completely fits a cylindrical adhesive cartridge 18.

A head piece 70 is attached at a second end 16 of the body 12 by means of an attachment cuff 72. The head piece includes a static mixer 34A and a plurality of resiliently biased locating members 62 which are radially arranged around a capped end 73 of the head piece, each of which downwardly extends from the head piece to inwardly bias as it comes into contact with the rock hole wall, when the anchor 10A is inserted into a rock hole 58. Each member outwardly presents a ribbed surface 75 which grip the walls of the rock hole to hold the rock anchor temporarily in position before the anchor is fixed in place with an adhesive.

The head piece 70 has a plurality of radially spaced resiliently deformable formations 74, each of which upwardly projects and inwardly biases as the head piece 70 is inserted into the cuff 72, when engaged with the anchor body 12 in assembly of the anchor 10A, to locate within an annular groove 75 in a snap lock manner. By press-fitting the cuff with the second end of the body 12, the head piece is thereby attached to the body 12, in fluid communication with the cartridge 18 contained therein. And the head piece is prevented from being withdrawn from the cuff by ends of the formations 74 abutting against the groove 75.

The adhesive cartridge 18 includes a cylindrical housing 19, made of a suitable rigid plastics material, which has a leading end 20 and a trailing end 24. Within the housing, a corrugated tube 76 is located, co-axially aligned with the housing. The tube has an open end 78 and an opposed closed end 80. The open end is in fluid communication with the static mixer, via a sealing member 82.

A valve assembly 44 is located at a first end 14 of the anchor body 12, in fluid communication with the cartridge 18. As illustrated in FIG. 3, the assembly is press fitted into a trailing end portion 24 of the housing 19.

The corrugated tube 76 has a bellows type body, made of a suitable non-frangible, flexible plastics material which comprises of a plurality of corrugated annular zones, respectively designated 84A, 84B, 84C . . . 84N, each of which is adapted to buckle when pressure is applied to the tube at its closed end 80, such that the tube axially compresses in a controlled predictable manner.

Within the corrugated tube, which defines a first adhesive containing compartment within the cartridge 18, a first adhesive component of a multi component adhesive is contained.

Between an outer surface 86 of the tube 76 and an inner surface 88 of the cartridge housing 19, an annular reservoir 90 is defined in which a second adhesive component of the multi component adhesive system is located. The annular reservoir defines a second adhesive containing compartment. The annular reservoir is also in fluid communication with the static mixer, via the sealing member 82.

A pressing member 30A is located within the housing, between the closed end 80 of the tube 76 and the housing's trailing end 24 and, as described above, with respect to the various embodiments of the sealing member, each member is adapted to form a seal between the inner surface 88 of the housing and the pressing member, thereby sealing the annular reservoir 90 at this end. The leading face 92 of the pressing member can be attached to the tube's closed end 80.

The sealing member 82 is press fitted into, and then fixed to, the leading end 20 of the cartridge housing 19 sealingly to inter-connect the head piece 70, and the static mixer 34, to the cartridge 18 in fluid communication, within the confines of the cuff 72. The sealing member presents a second ring seal 94 between it and an interior surface of the cuff.

A central aperture 96 and a plurality of radially arranged holes 98 are formed through the sealing member. Each of these apertures is initially closed with a plug component 100 from the central aperture, inwardly projecting into the housing, extends an annular ring formation 102, over which an extension 104 of the tube's open end 78 resiliently is slid and fastened in place. Thus, when the aperture 96 is open, the tube's adhesive content can flow from the open end, through the aperture and into the static mixer. Likewise, the holes 98 allow the adhesive content from the annular reservoir 90 to flow into the static mixer when open as each of these apertures are positioned through the member 82 to be axially in register with the reservoir.

The plug component 100 has, in this particular embodiment, a steering wheel appearance to complement the arrangement of the aperture and the holes 96 and 98 respectively, in the sealing member 82. The component 100 includes a central plug 106 which is complimentary shaped and dimensioned to fit within the central aperture 96 and a plurality of radial plugs 108, each of which fits within a respective hole 98. The central plug is interconnected with each of the radial plugs by a plurality of radial spokes 110. A circular interconnecting member 112 interlinks each of the radial plugs 108. When in place, the plug component 100 seals off the apertures and each hole to prevent egress of the adhesive components from respective compartments. The benefit of interconnecting the plugs is that, when one plug is lifted from its respective aperture or hole by pressure exerted by the volumetric decrease in the compartments as explained below, it pulls the remaining plugs from their respective aperture or hole so that the apertures and all of the holes open simultaneously.

In use, with the rock bolt 10A fully assembled and inserted into the rock hole 58, and a faceplate engaged with the bolt, drawn up into abutment with the rock face by means of a nut (not shown) engaged with the threads of a threaded cuff 115, a fluid is introduced under pressure, into the cartridge 18, behind the pressing member 30, through an inlet valve of the assembly 44. The fluid input causes the pressing member to advance, within the housing 19, towards the leading end 20 and, in so doing, the corrugated tube 76 buckles in concertina fashion, about each annular zone 84, as illustrated in FIG. 5.

The first adhesive component and the second adhesive component, within the tube 76 and the annular reservoir 90 respectively, are brought under increased pressure by the action of the pressing member such that plugs (106, 108) are lifted simultaneously from their aperture and the holes respectively to open the aperture and the holes to allow the adhesive components to extrude, in a predetermined mixed ratio, from the cartridge 18 into the head piece 70 and the mixing formations of the static mixer 34A.

As illustrated in FIG. 4, the static mixer 34A includes a spiral insert 130, defining a spirally arranged channel 132, which locates within the head piece 70, and a spiral formation 133 which is arranged helically within the channel 132. The surface area of the thread-like body of the formation 133 is increased by presenting a high density of mixing formations 135, repetitively configured along the length of the formation's body. This arrangement of the spiral formation, carrying mixing formations, helically wound around the spiral insert dramatically increases the distance through which the adhesive components travel within the relatively confined length of the head piece.

As the first and second adhesive components move through the static mixer 34A, under pressurised reaction from the advancing pressing member 30A, they are mixed before being expelled from the head piece 70 through a plurality of holes 114 under the capped end 73 umbrella.

The now mixed multi-component adhesive system flows from the head piece 70, between the outer surface 64 of the rock bolt 10A and the walls of the rock hole 58 to set within the annular space 68 and thus fix the rock bolt securely within the rock hole.

Figure 6:
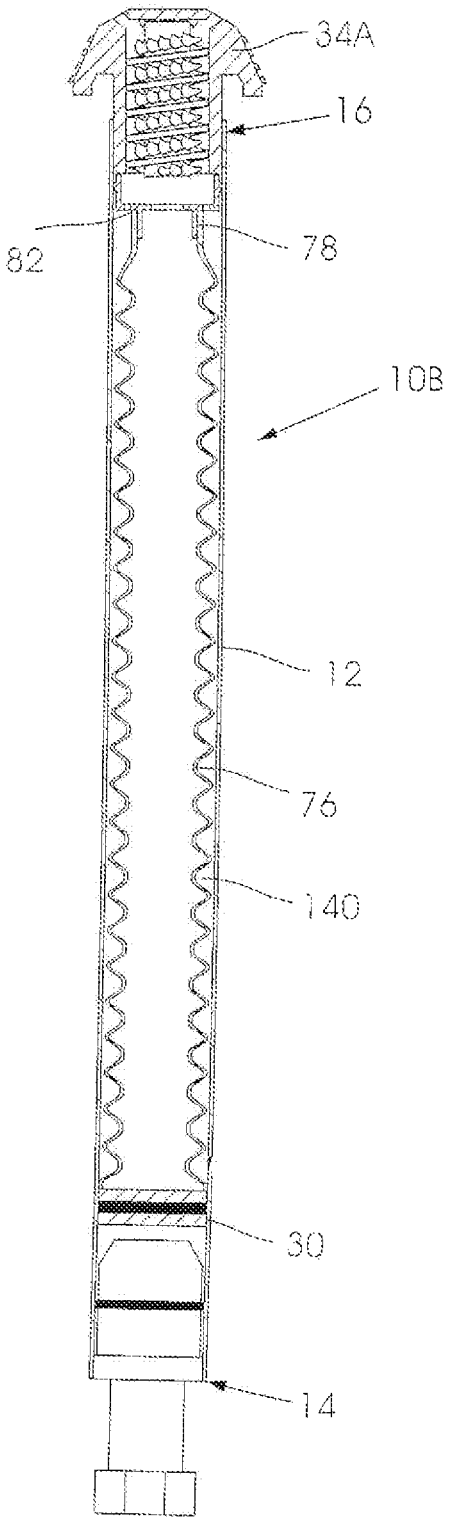
FIG. 6 illustrates, in longitudinal section, a rock anchor in accordance with a third aspect of the invention.

In describing a third and a fourth aspect of the invention, like features, with respect to the first and the second aspects of the invention, again bear like reference numerals. The third aspect of the invention is described with respect to FIG. 6. In this aspect, a rock bolt 10B is provided which has a tubular body 12 within which a corrugated tube 76 is located, between a sealing member 82, to which the open end 78 of the tube is attached, and a pressing member 30. In this embodiment the corrugated tube 76 is not housed within a cartridge, but directly assembled within the rock bolt body. A first adhesive component of a multi-component adhesive, is contained within the tube and a second adhesive component is contained, if required, within an annular space 140 defined between the walls of the tubular body and the corrugated tube 76. The pressing member, moves within the tubular confines of body 12, sealingly engaged with the body's inner walls.

Figure 7:
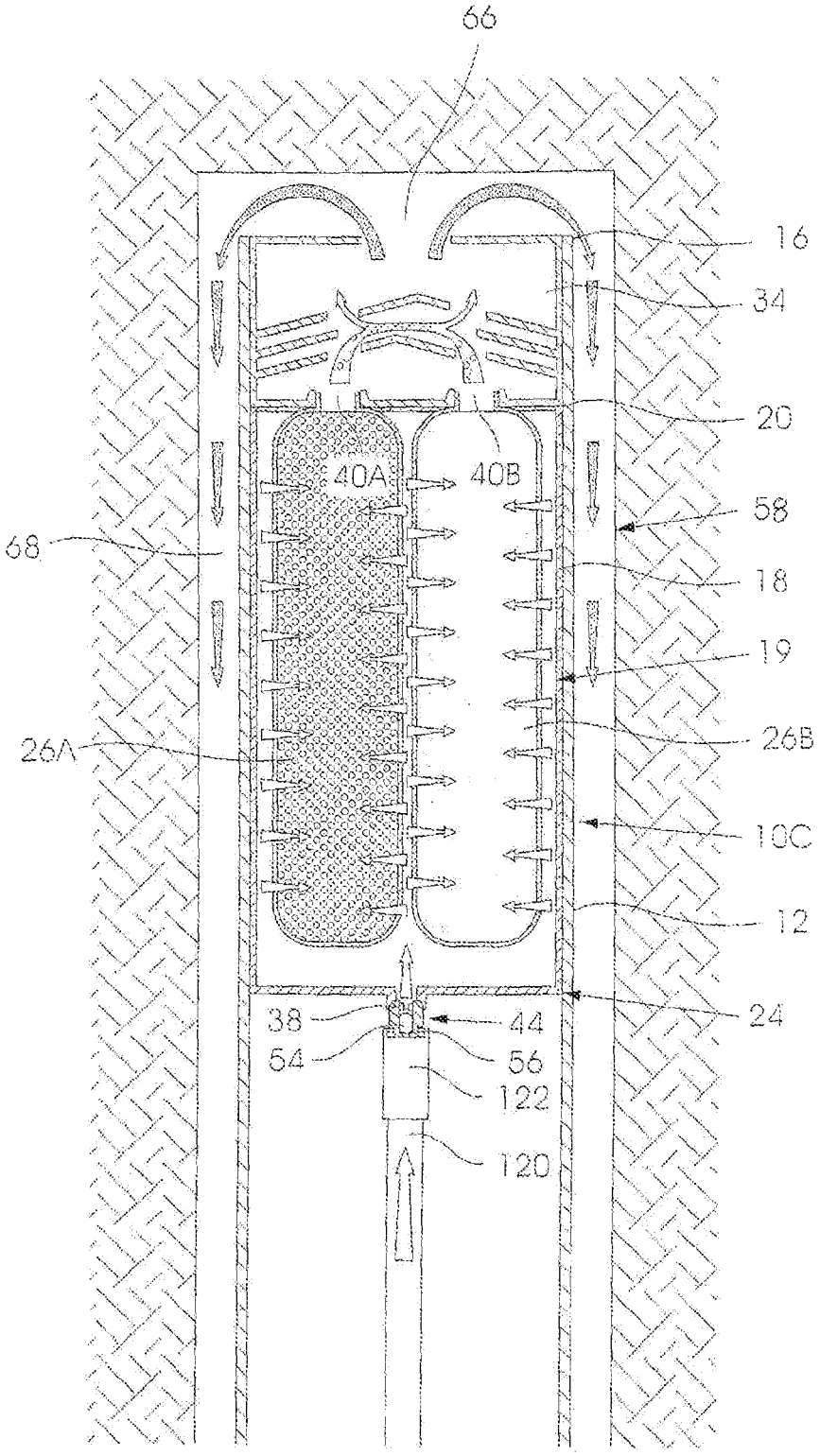
FIG. 7 diagrammatically illustrates a rock anchor in accordance with a fourth aspect of the invention.

In a fourth aspect of the invention, as illustrated in FIG. 7 of the accompanying drawings, there is provided a hollow tubular rock anchor 10C which includes an elongate tubular body 12, which extends between a first end (not shown) and a second end 16. Inserted within the tubular body is a complementary shaped and dimensioned static mixer 34 and, behind the static mixer, a cartridge 18 for containing a multi-component adhesive system.

The adhesive packing cartridge 18 includes a rigid tubular housing 19 which is shaped and circumferentially dimensioned to fit within the anchor body 12, and has a leading end 20 and a trailing end 24. Within the housing, a first compartment 26A, containing a first adhesive component, and second compartment 26B, containing a second adhesive component, is located.

Through the trailing end 24 wall of the housing 19, a fluid inlet valve assembly 44 is provided which contains a valve element 54, located in a bore 38 which forms a conduit through which a pressurized fluid, for example water, enters the housing from a fluid source via a fluid hose 120.

Each of the compartments 26A and 26B, in this particular example, are volumetrically equal and discrete in that they are spaced from respective side walls of the housing and from each other. Each of the compartments is tubular in form, made from a resiliently deformable sheet material for example aluminium sheet.

In use, a nozzle end 122 of the hose 120, connected to a pressurized fluid source, is connected to a hose coupling formation 56 and water, under pressure, enters the interior of the housing. As the amount of water increases within the volumetrically constant confines of the housing, fluid pressure, initially hydraulic and later hydrostatic, is exerted on the resiliently deformable walls of the first and the second compartments, causing each of the compartments to inwardly collapse, reducing their respective volumes and respectively forcing the first and second adhesive components out through respective outlets 40A and 40B formed through the leading end 20 wall of the housing.

Each compartment 26 is in fluid communication with the static mixer 34 via the outlets 40, wherein the components mix and pass from the mixer through aperture 66 into an annular space 68, wherein the adhesive mixture sets and hardens to fix the rock anchor 10C within the rock hole 58.

Figure 8:
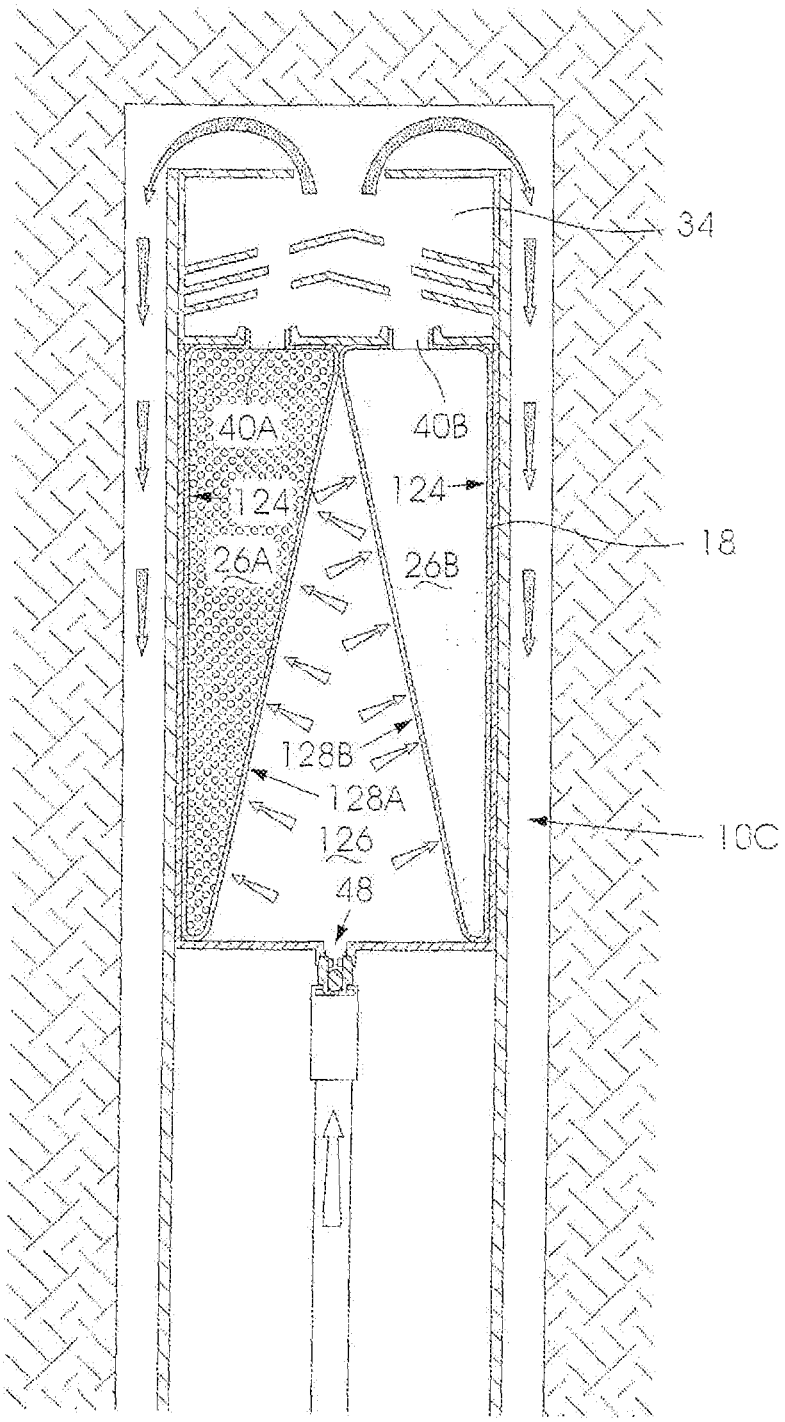
FIG. 8 diagrammatically illustrates another embodiment of the rock anchor of the fourth aspect of the invention.

In a second embodiment of this aspect of the invention, illustrated in FIG. 8, an adhesive packaging cartridge 18 is disclosed which, unlike the previous embodiment, does not include discrete first and second compartments. Each of the first and second compartments 26A and 26B of this embodiment have outer facing walls 124 which are attached to, or are integrally formed with, respective walls of the cartridge housing.

Into a conically shaped interior 126 of the housing, water enters, from an inlet 48, to produce hydro-static forces against interior facing walls 128A and 128B of compartments 26A and 26B respectively, which, as they are made from the same resiliently deformable material as described above with reference to FIG. 7, collapse towards the housing walls thereby reducing the internal volumes of the respective compartments to cause the respective adhesive components to extrude through respective outlets 40A and 40B.

As described above, with respect to the first embodiment, the outlets 40A and 40B are in fluid communication with static mixer 34 so that the extruded adhesive components mix within the static mixer and flow there-through.

Going back to the first aspect of the invention, described above with reference to FIGS. 1 and 2, a specific embodiment of the rock anchor of this aspect is described below, with reference to FIGS. 9 to 12.

Figure 9:
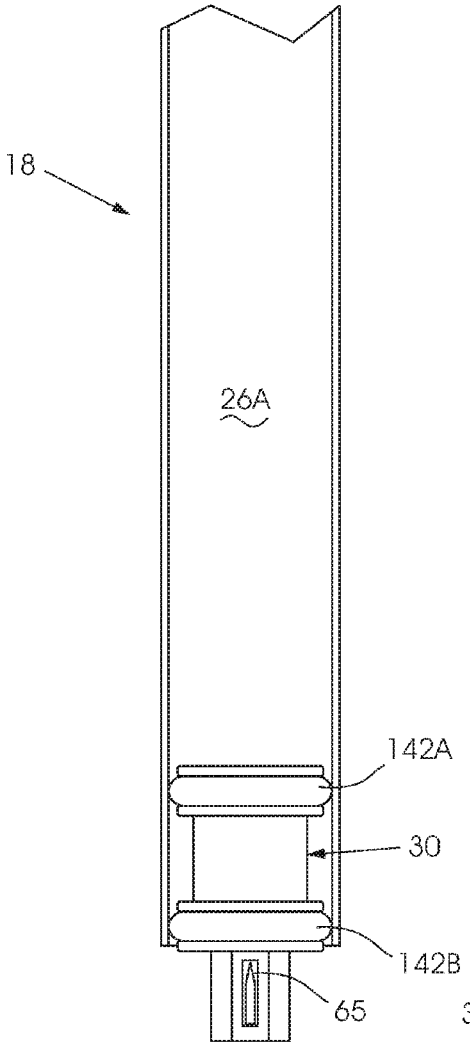
FIGS. 9 and 10 illustrate, in longitudinal section, an adhesive containing cartridge for a rock anchor in accordance with a second embodiment of the first aspect of the invention.
Figure 10:
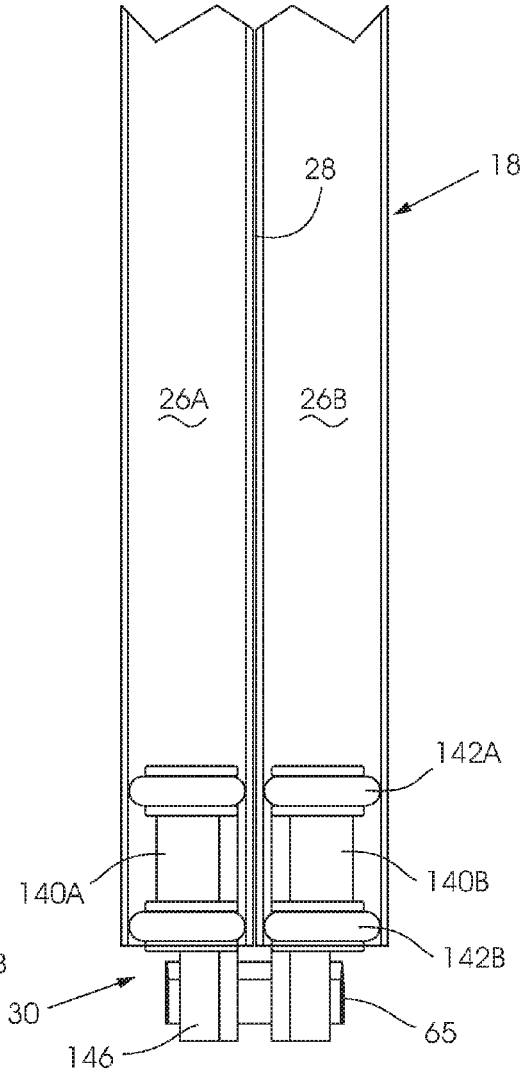
Figure 11:
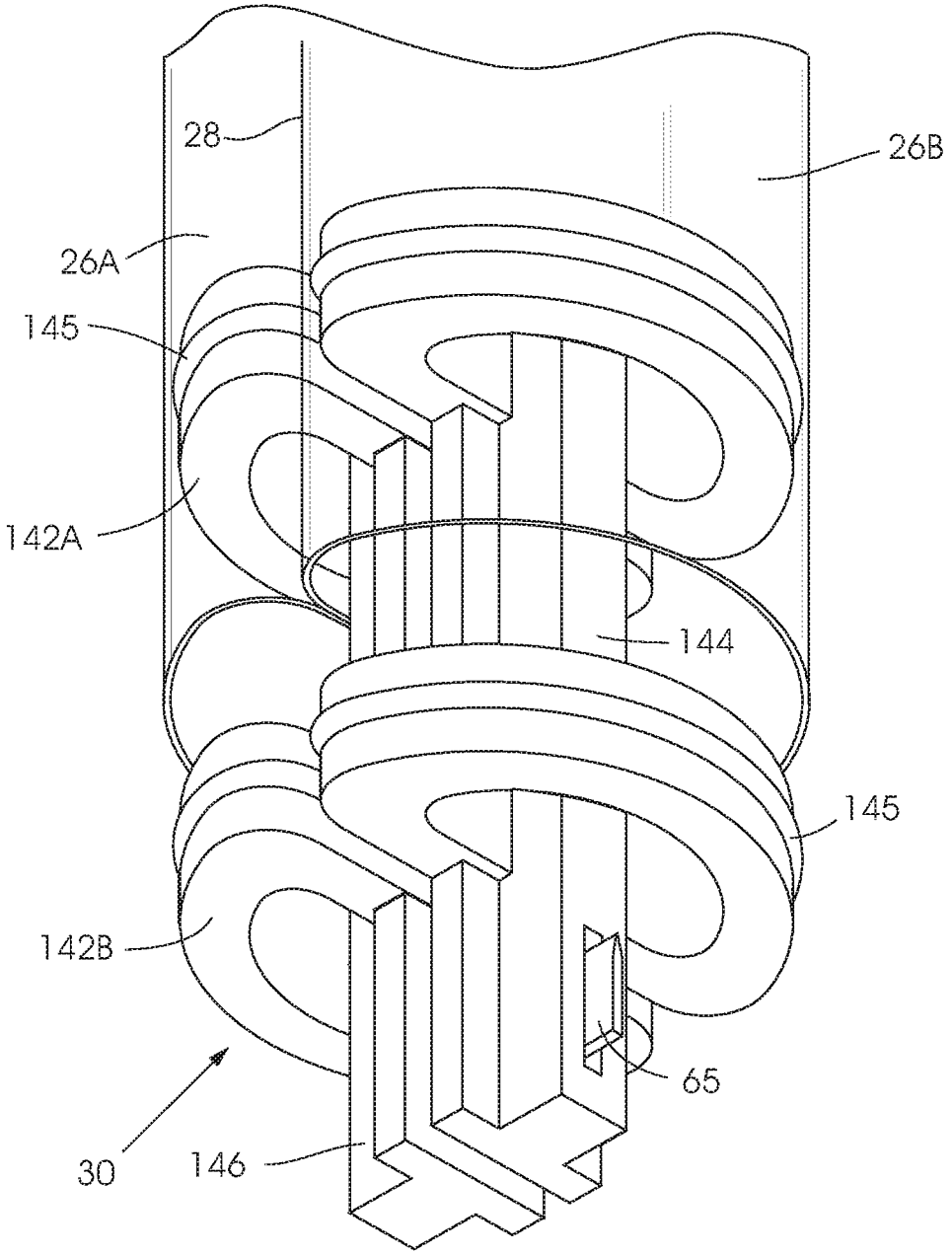
FIG. 11 is a view in perspective of the cartridge of FIGS. 9 and 10.

FIGS. 9, 10 and 11 illustrate a cartridge 18 which is inserted into the tubular body of a rock anchor 10. For ease of explanation, however, no further explanation is advanced to the ancilliary structure of the rock anchor, and instead explanatory focus is on the cartridge itself and the differences with prior embodiments. Again, in describing the cartridge of this embodiment, like features bear like designations.

The cartridge 18 is comprised of a pair of cross-sectionally kidney shaped compartments, respectively designated 26A and 26B. This shape is illustrated in FIG. 11. The compartments are co-joined, separated by a partitioning wall 28.

The pressing member 30 of this embodiment comprises of two separate piston elements, respectively designated 140A and 140B. Each piston element includes, in a preferred example which is not intended to be limiting, a pair of sealing formations, an advance sealing formation designated 142A and a trailing sealing formation designated 142B, joined together by an axial spine 144. Each sealing formation is complementarily shaped to the lumen of the respective compartment 26 to allow passage through the compartment. Each sealing formation 142 has a circumscribing sealing ring 145 which engages with the walls of the compartment to provide sealing passage to the sealing formations, preventing backflow of the adhesive component contents.

Behind each trailling sealing formation 142B, a blade 65 is located, transversely positioned between trailing sections 146 of each spine 144. As is best illustrated in FIG. 11, before use, the trailing sealing formations 142B and the blade are located outside of their respective compartment and yet are orientated in register with each compartment, to allow smooth entry and passage, by being joined in longitudinal alignment to the respective advance sealing formations 142A.

It is preferable to have a pair of sealing formations per piston element to double up on the sealing function and to have compartments sealed well in advance of the trailing blade. However, a single sealing formation is contemplated within the scope of the invention. Each compartment is made of a plastics material, suitable to being relatively easily severed.

In its transverse position, between the piston elements 140, the blade 65 is optimally positioned to sever the portioning wall 28 as the pressing member 30 is caused to advance, under force of the introduced working fluid as described above, to facilitate passage of each inter-linked piston element through the respective compartment.

Having the piston elements inter-linked ensures that the rate of advance through the compartments remains the same so that the rate of extrusion of the respective adhesive component content is the same, irrespective of any density differential between the differing adhesive components.

Figure 13:
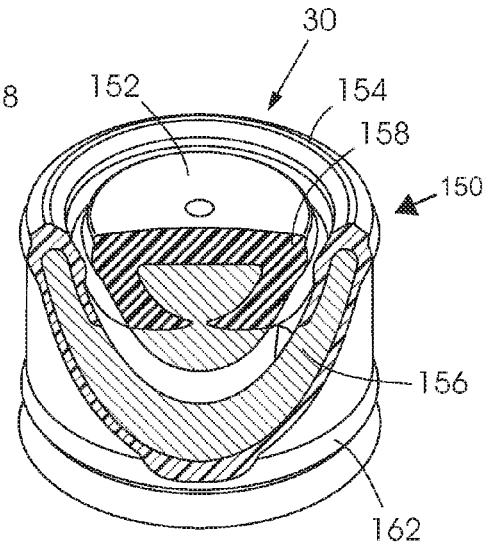
FIG. 13 is an isometric, partially sectioned view of a pressing member located with the cartridge of FIG. 12.
Figure 14:
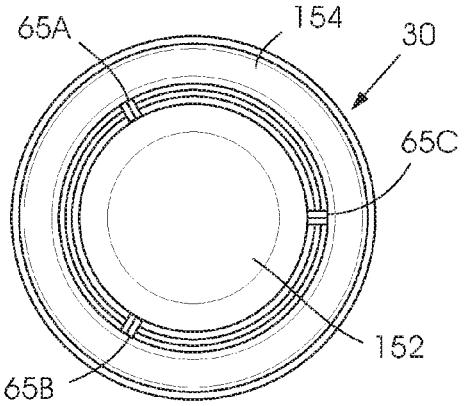
FIG. 14 is a view in plan of the pressing member.

A final embodiment of the first aspect of the invention is described with reference to FIGS. 12 to 14 of the accompanying drawings. In describing this embodiment focus is again placed on a cartridge 18 which is inserted into a rock anchor 10.

The cylindrical cartridge housing 19 of this embodiment includes a cylindrical tube 76 which is positioned co-axially within the cartridge. The annular space between the cartridge and the tube defines a first compartment 26A and a second compartment 26B is defined within the tube. The compartments are divided by a wall 28 of the tube. Each compartment contains a discrete fluid component of a two part adhesive system.

Figure 12:
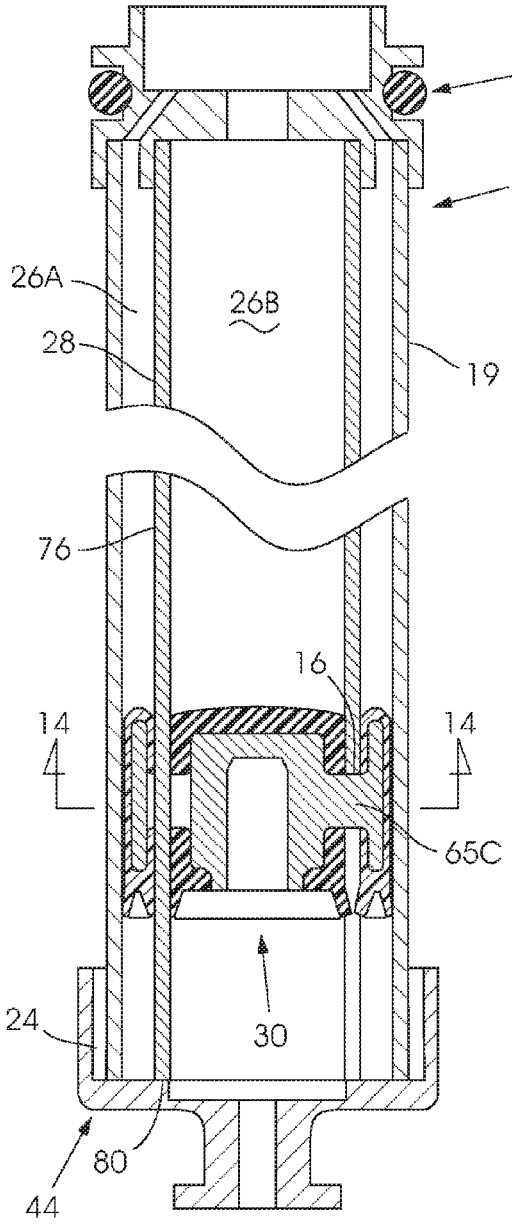
FIG. 12 is a longitudinal section through an adhesive containing cartridge for a rock anchor in accordance with a third embodiment of a first aspect of the invention.

For the sake of completeness and context, the cartridge is shown in FIG. 12, engaged with a static mixer 34 at a leading end 20 of the cartridge and a fluid inlet valve assembly 44 engaged at a trailing end 24. The rock bolt body is not illustrated.

A pressing member 30 is provided, initially located (i.e. before use of the rock bolt), towards ends 24 and 80 of the cartridge 18 and tube 26 respectively. The pressing member, as best illustrated in FIG. 13, has a unitary body 150 comprising of a first cylindrical central part 152 and a second tube-like outer part 154. The first part and the second part are unitarily inter-linked by a blade formation comprising of three radially arranged blades, respectively designated 65A, 65B and 65C (see FIG. 14).

The pressing member has a core 156 made of a suitable resilient plastics material, coated with an outer sealing layer 158 of a rubber-like material which is sufficiently strong yet flexible enough to provide adequate sealing. This sealing layer is moulded to provide a number of annular sealing ridges 162 (see FIG. 13). The blades are not coated with the sealing layer and initially each presents a cutting edge 164 to the end 80 of the tube 76.

The first part and second part (152, 154) of the pressing member body 150 are complementarily shaped and dimensioned to sealingly locate, initially at least partially, within the tube and the annular space respectively to respectively seal off the first and second compartments (26), from a trailing position as the sealing member 30 advances.

As described above, fluid input behind the pressing member 30 causes the pressing member to advance within the cartridge 18 and tube 76 respectively. As the pressing member advances, the blades 65 cut into the wall 28 of the tube 76 to facilitate the advance, whilst sealing engagement is maintained by the respective parts (152, 154) against the respective walls surfaces, to force the respective adhesive component out of each compartment 26 towards the static mixer 34 whilst preventing backflow.

What is claimed is:

1. A rock anchor comprising:

an elongate tubular body;

a cartridge positioned in the elongate tubular body and having a rigid tubular housing with a leading end and an opposed trailing end;

a first compartment and a second compartment defined within the cartridge;

a first adhesive component positioned within the first compartment;

a second adhesive component positioned within the second compartment fluidly separated from the first adhesive component by a partitioning wall;

a fluid inlet valve assembly engaging the trailing end, the fluid inlet valve assembly connectable to a fluid source to introduce fluid into the cartridge;

a mixer positioned within the elongate tubular body at the leading end of the cartridge; and a pressing member positioned within the cartridge towards the trailing end, the pressing member including a bladed formation which is operable to sever the wall when the bladed formation is caused to advance towards the leading end in response to fluid flowing into the cartridge, to thereby force the first adhesive component from the first compartment and the second adhesive component from the second compartment towards the leading end and into the mixer.

2. The rock anchor of claim 1, wherein the pressing member is sealingly engaged with the cartridge housing, and wherein the rigid tubular housing is made from a rigid plastics material.

3. A rock anchor comprising:

an elongate tubular body;

a cartridge positioned in the elongate tubular body and having a rigid tubular housing with a leading end and an opposed trailing end;

a first compartment and a second compartment defined within the cartridge;

a first adhesive component positioned within the first compartment;

a second adhesive component positioned within the second compartment fluidly separated from the first adhesive component by a partitioning wall;

a fluid inlet valve assembly engaging one end of the tubular body adjacent the trailing end, the fluid inlet valve assembly connectable to a fluid source to introduce fluid into the body and the cartridge;

a mixer positioned at least partially within the elongate tubular body at the leading end of the cartridge; and a pressing member positioned within the cartridge towards the trailing end, the pressing member including at least one blade which is operable to sever the wall when the blade is caused to advance towards the leading end in response to fluid flowing into the cartridge, to thereby force the first adhesive component from the first compartment and the second adhesive component from the second compartment towards the leading end and into the mixer.

4. The rock anchor of claim 3, wherein the pressing member is sealingly engaged with the cartridge housing, and wherein the rigid tubular housing is made from a rigid plastics material.

5. The rock anchor of claim 3, wherein the leading end is closed and wherein the leading end includes an outlet from each of the compartments and wherein the mixer is a static mixer.

6. The rock anchor of claim 3, wherein the first and second adhesive components are mixed in the mixer prior to being dispensed out of the tubular body.

* * * * *